United States Patent [19]

Muto

[11] 4,014,731

[45] Mar. 29, 1977

[54] APPARATUS FOR BINDING ARTICLES WITH TAPE

[75] Inventor: Iwao Muto, Minami-ashigaramachi, Japan

[73] Assignee: Toshiba Seiki Kabushiki Kaisha, Japan

[22] Filed: Mar. 9, 1976

[21] Appl. No.: 665,311

[30] Foreign Application Priority Data

July 3, 1975 Japan ..... 50-81406

[52] U.S. Cl. ..... 156/350; 53/198 R; 100/17; 100/25; 100/34; 156/353; 156/468; 156/522

[51] Int. Cl.[2] ..... G05G 15/00; B65B 13/30

[58] Field of Search ..... 156/459, 468, 475, 522, 156/523, 350, 353; 100/2–4, 8, 16–17, 20, 25, 26, 33 R, 34; 53/198 R; 93/93 R

[56] References Cited

UNITED STATES PATENTS

| | | | |
|---|---|---|---|
| 2,409,724 | 10/1946 | Walter et al. | 156/468 X |
| 2,527,330 | 10/1950 | Prohaska | 156/468 X |
| 2,597,675 | 5/1952 | Sackett | 100/26 |
| 3,955,340 | 5/1976 | Tomita et al. | 53/198 R X |

*Primary Examiner*—David A. Simmons
*Attorney, Agent, or Firm*—Robert E. Burns; Emmanuel J. Lobato; Bruce L. Adams

[57] ABSTRACT

A pack of paper money is inserted into a binding apparatus and positioned within multiple loops of a tape in involuted state, whereupon clampers grasp the pack from opposites thereof, an extension on one clamper pressing and holding the inner leading end of the tape against the pack, and a roller device draws a trailing part of the tape to tighten the tape loops around the pack. A cutter cuts the tape at the trailing part to form an outer trailing extremity of the tape, which is stuck with adhesive to the tightened tape thereby to complete the binding of the pack. The moving parts of the apparatus are controlled and actuated automatically when the pack is inserted into binding position in the apparatus.

12 Claims, 6 Drawing Figures

APPARATUS FOR BINDING ARTICLES WITH TAPE

BACKGROUND OF THE INVENTION

The present invention relates to apparatuses for binding articles, particularly three-dimensional articles, and more particularly articles of the shape of a rectangular parallelepiped such as a pack of paper money.

Many types of apparatus have been proposed heretofore for binding with tape a solid article, for example, a wad or pack of paper money and the like. Most of these apparatuses bind each article with a single turn of tape, which results in insufficient binding, although these apparatuses are simple in structure. On the other hand, apparatuses which apply a plurality of turns of tape around each article have the disadvantage of complexity of structure because either the tape or the article must be rotated in order to apply a plurality of turns of tape.

SUMMARY OF THE INVENTION

The present invention is similar to apparatuses of the prior art in that tape is fed by feeding and retracting roller means to encircle around a pack of paper money, for example, and the leading end of the tape is grasped, the tape then being retracted and constricting the pack by reversing the roller means, whereby the bundle is bound. However, an object of the present invention is to provide a binding apparatus of this type of simple structure using tape which can wrap the tape around an article a number of times, draw the tape tight around the article, and fix the tape thereby to bind the article.

According to this invention, briefly summarized, there is provided apparatus for binding articles with tape comprising: means for receiving an article and positioning the same in a specific binding position; tape roller means for feeding a specific length of a free end portion of a tape from a tape supply and subsequently drawing back the tape; a tape guide for guiding the tape free end portion into a voluted and looped state of a number of turns around the article thus positioned and to move in a manner to separate from and leave the tape in the voluted state; clamping means for clamping and holding the article in the binding position and holding the extreme leading end of the bound tape against the article, the tape then being drawn back by the tape roller means and then being bound tight around the article; cutting means for cutting off the tape thus bound from the tape being fed, thereby forming an extreme trailing end of the bound tape; securing means for securing the trailing end to the tape thus bound; and control and actuating means operating upon reception of the article by the article receiving means to operate automatically in appropriate sequence the tape roller means, the tape guide, the clamping means, the cutting means, and the securing means.

The nature, utility, and further features of this invention will be apparent from the following detailed description with respect to a preferred embodiment of the invention when read in conjunction with the accompanying drawings in which like parts are designated by like reference numerals and characters.

DETAILED DESCRIPTION

Figure 1:
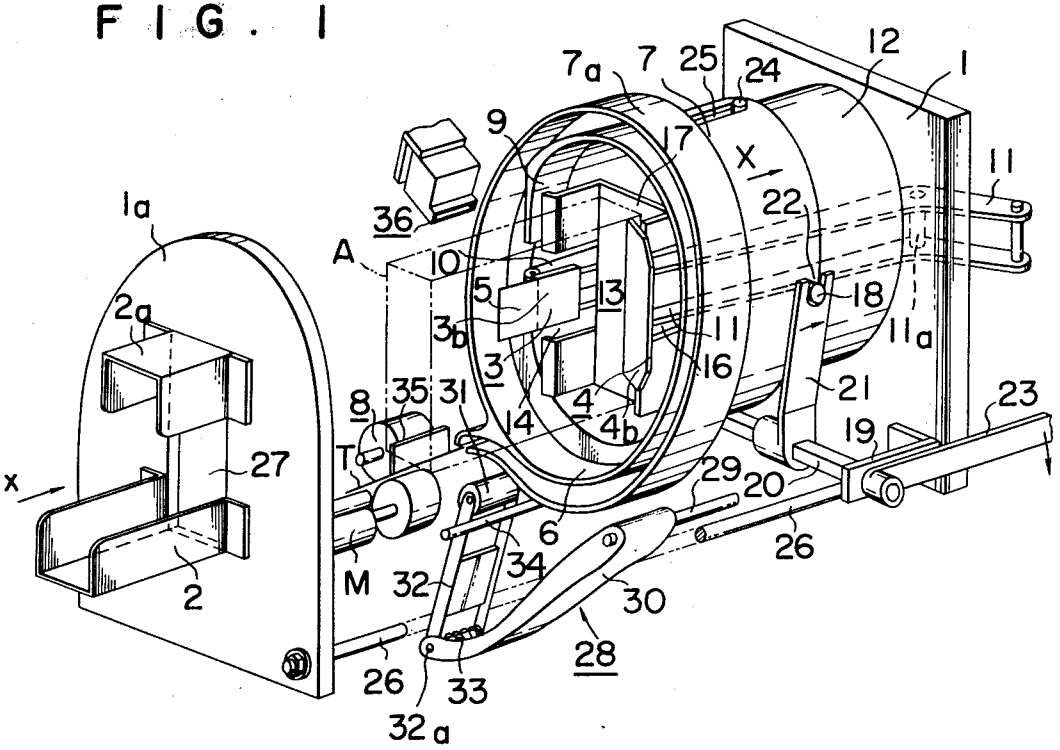
FIG. 1 is a perspective view, with some parts cut away, showing an example of a binding apparatus using tape according to the present invention.
Figure 3:
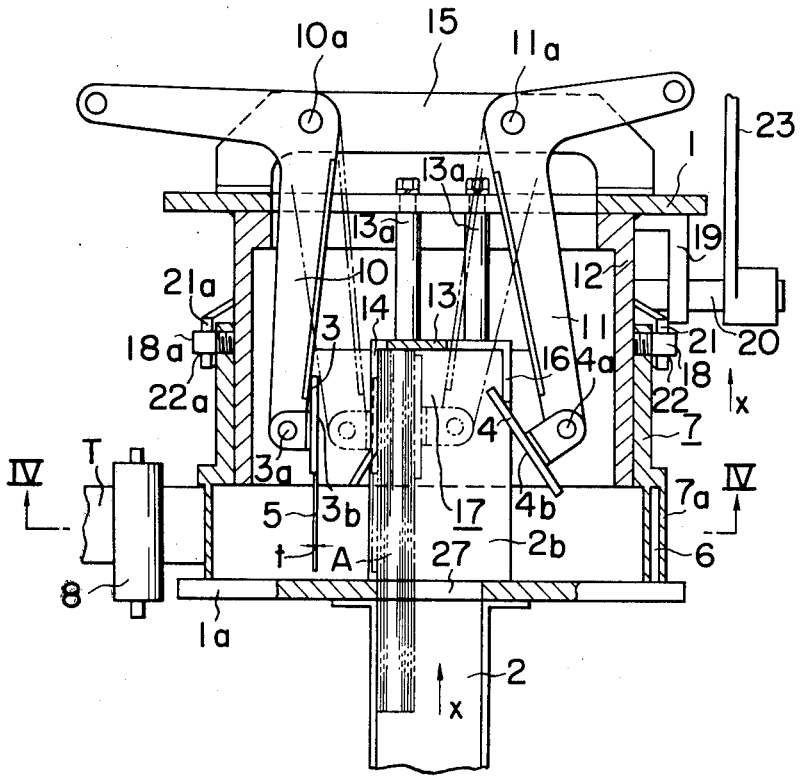
FIG. 3 is a view similar to FIG. 2 but showing the clamping means in the state of releasing the pack.
Figure 4:
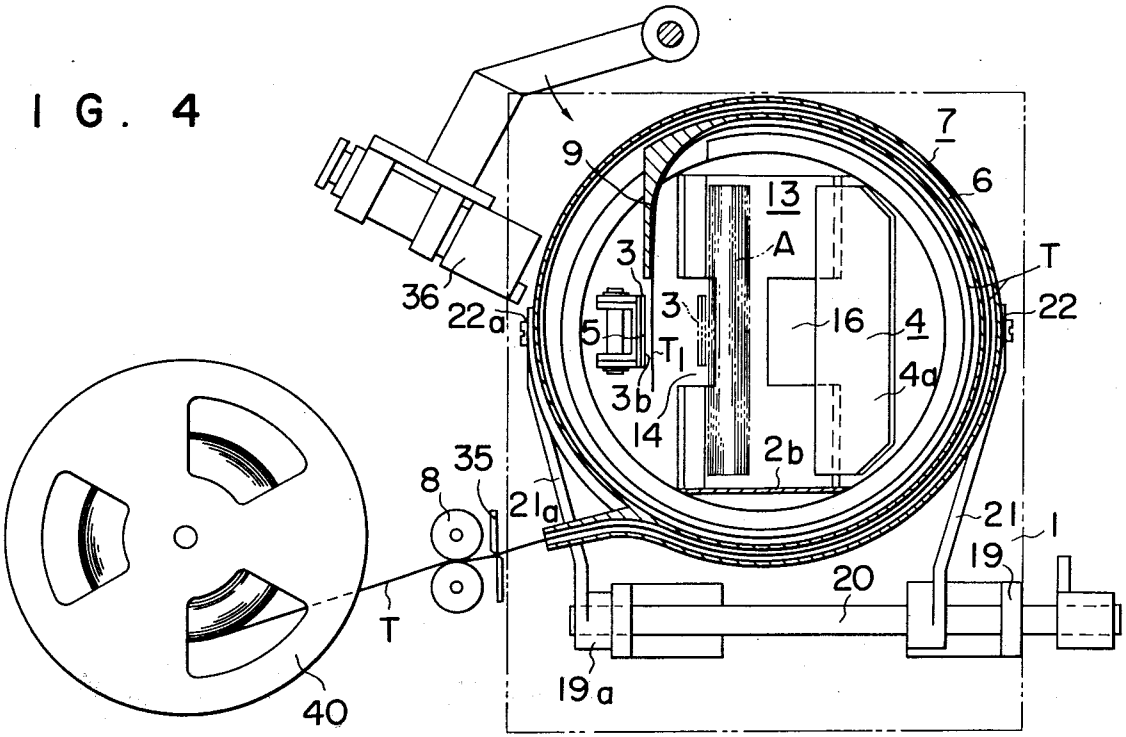
FIG. 4 is a vertical section taken along the line IV—IV of FIG. 3 and showing the manner in which the tape in guided.

In the drawings there is shown one example of the binding apparatus according to the invention which has, as shown in FIGS. 1 and 3, a vertical frame plate 1 and a horizontal cylindrical case 12 which is fixed at one end thereof to the plate 1. Inside the cylindrical case 12, there is provided a vertical article stop wall 13, which receives and stops the inner end of an article A (hereinafter referred to as a pack of paper money A) inserted in the apparatus in order to be bound by a tape T and is fixedly connected to the frame plate 1 by means of a pair of supporting rods 13*a*.

Inside the cylindrical case 12, a pair of bell crank levers 10 and 11 are provided, which are pivotally mounted on a bracket 15 by pins 10*a* and 11*a*, respectively, the bracket 15 being fixed to the outer surface of the plate 1. On the free ends of the levers 10 and 11 within the cylindrical case 12, pack clampers 3 and 4 are pivotally mounted by pins 3*a* and 4*a*, respectively. The clamping surface 3*b* of one clamper 3 has a shorter dimension in height but a longer dimension in the fore-and-aft direction, i.e., the direction in which the pack A is inserted and extracted, than the clamping surface 4*b* of the other clamper 4, whereby an extension 5 in the rearward direction is formed in the clamper 3. The thickness *t* of this extension is less than that of the remaining part of the clamper 3.

The vertical stop wall 13 is formed with a U-shaped cross section as viewed in plan view. One side portion of the wall 13 has a cutout 14 so as to permit the clamper 3 to pass through the cutout 14 into a U-shaped groove 17 defined by the wall 13. The opposite side portion is also formed with a cutout 16 which permits the clamper 4 to pass into the groove 17. The clamper 4 is always disposed in the groove 17.

A cylindrical tape guide 7 is slidably mounted over the outer or rear end of the aforementioned case 12 and is adapted to slide telescopically over the base 12 in the axial direction or fore-and-aft direction thereof. The cylindrical tape guide 7 has a portion 7*a* formed integrally therewith and having a voluted tape guide passage 6. The passage 6 opens on outerside thereof and is shaped so as to encircle the outer side of the extension 5. Pins 18 and 18*a* project from the cylindrical guide 7 at the sides thereof respectively. These pins 18 and 18*a* are engaged in yoke portions 22 and 22*a*, respectively, at the free ends of tape guide actuating arms 21 and 21*a*, the other ends of which are secured to an square shaft 20 which is rotatably received at its ends in bearing journals respectively in a pair of brackets 19 and 19*a* fixed to the inner surface of the frame plate 1 at lower corners thereof. To the one end of the square shaft 20 is fixed an operating lever 23, the swinging motion of which lever 23 causes the angular shaft 20 to rotate.

A pin 24 projects from the top of the case 12. The pin 24 is slidably engaged in a slot 25 formed in the top of the cylindrical tape guide 7 in the direction of the longitudinal axis thereof, so that the cylindrical tape guide 7 can be moved over the cylindrical case 12 in parallel to the direction of a pack inserted (direction *x*) without rotating by the swinging motion of the lever 23.

Another vertical plate 1*a* is arranged to cover the open side of the voluted tape guide passage 6 and is connected to the frame plate 1 by connecting rods 26. The vertical plate 1*a* is provided with a rectangular opening 27 for inserting a pack A, the opening being shaped to be longer in height than in width as shown in FIG. 1. Pack guiding troughs 2*a* and 2 are fixed to the plate 1*a* at the upper and the lower ends of the rectangular opening 27, respectively. The lower trough 2 also serves to support as well as to guide a pack and is connected to a pack supporting plate 2*b* disposed on the inner side of the vertical plate 1*a*.

The tape feeding-out end 9 of the voluted tape guide passage 6 is so positioned that the end T1 of the guided tape T can depend between the clamping surface 3*b* of one clamper 3 with the extension 5 and one side of the pack A. Tape end adhering roller means 28 is provided under the voluted tape guide passage 6. The roller means 28 comprises a rotatable shaft 29, a larger arm 30 fixed to the shaft 29 at one end and a smaller arm 32 carrying a roller 31 at one end, the other end of the smaller arm 32 being pivotally connected to the other end of the larger arm 30 by a connecting pin 32*a*, around which pin 32*a* a coil spring 33 is disposed. The smaller arm 32 is adapted to be always biased against to a stop rod 34.

In addition, a tape cutter 35 and an adhesive feeder 36 are provided as shown in FIG. 1 at positions suitable for their respective operations as described hereinafter.

A pair of tape feeding and drawing back roller means 8 have a nip therebetween through which the tape T is passed. The tape T is drawn from a tape reel 40. One roller of the roller means 8 is driven by a reversible motor M shown in FIG. 1.

In the operation of the apparatus of the above described construction according to the invention, the motor M of the tape feeding and drawing back roller means 8 is operated to feed the tape T forward when a pack A is inserted through the pack guiding trough 2 of the vertical plate 1*a* and its leading end abuts against the vertical stop wall 13 to actuate a sensing means (not shown) for sending a signal to the motor M. Consequently, the tape T is directed through the voluted tape guide passage 6 and encircles the pack A two times. Then, the leading end T1 of the guided tape T depends from the tape feeding-out end of the passage 6 between the clamping surface 3*b* of the clamper 3 and one side of the pack A. The roller means 8 is adapted to stop its operation under control of a control means (not shown) after feeding out a required length of tape.

Figure 2:
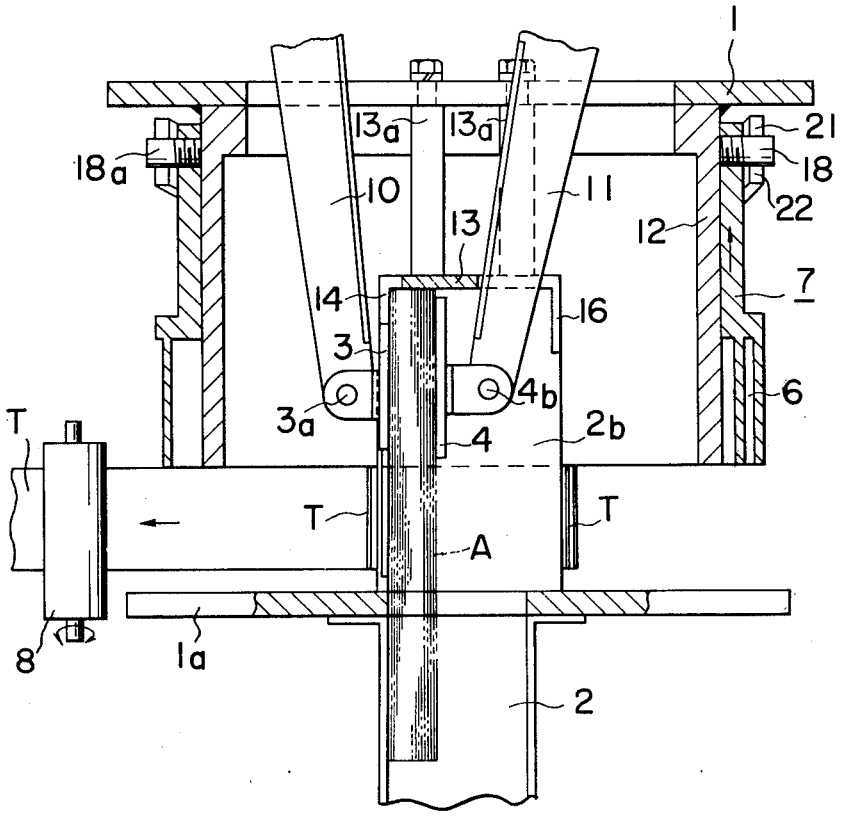
FIG. 2 is a top plan view, with parts in section, of a part of the apparatus, showing clamping means in the state of grasping a pack of sheet material.

Then, the control means operates the pair of levers 10 and 11 to swing them toward each other to cause the clampers 3 and 4 to grasp the pack A from both sides as shown in FIG. 2. At this time, the leading end T1 of the tape T is held tightly between the extension 5 of the clamper 3 and the pack A. Then, the swinging of the lever 23 causes the cylindrical tape guide 7 to move in the direction of insertion of the pack, that is, in the direction *x* through the movement of the shaft 20 and arms 21 and 21*a*, so that, as the voluted tape guide passage 6 is open at one side, the guided tape is released as a whole from the guide passage 6 and remains around the pack A in a voluted condition.

The tape which has been in a loosely encircling state around the pack A and the extension 5 of the clamper 3 is thereupon wound tight a number of times around the pack A together with the extension 5 by the operation of the control means which reverses the motor M of the tape feeding and drawing back roller means 8, as shown by arrows in FIG. 2. At this time, the other clamper 4 cooperates with that part of the clamper 3 other than the extension 5 thereof to grasp the leading portion of the pack A. When the pack A has been taped tightly, the tape feeding and drawing back roller means 8 is stopped by the control means.

Figure 5:
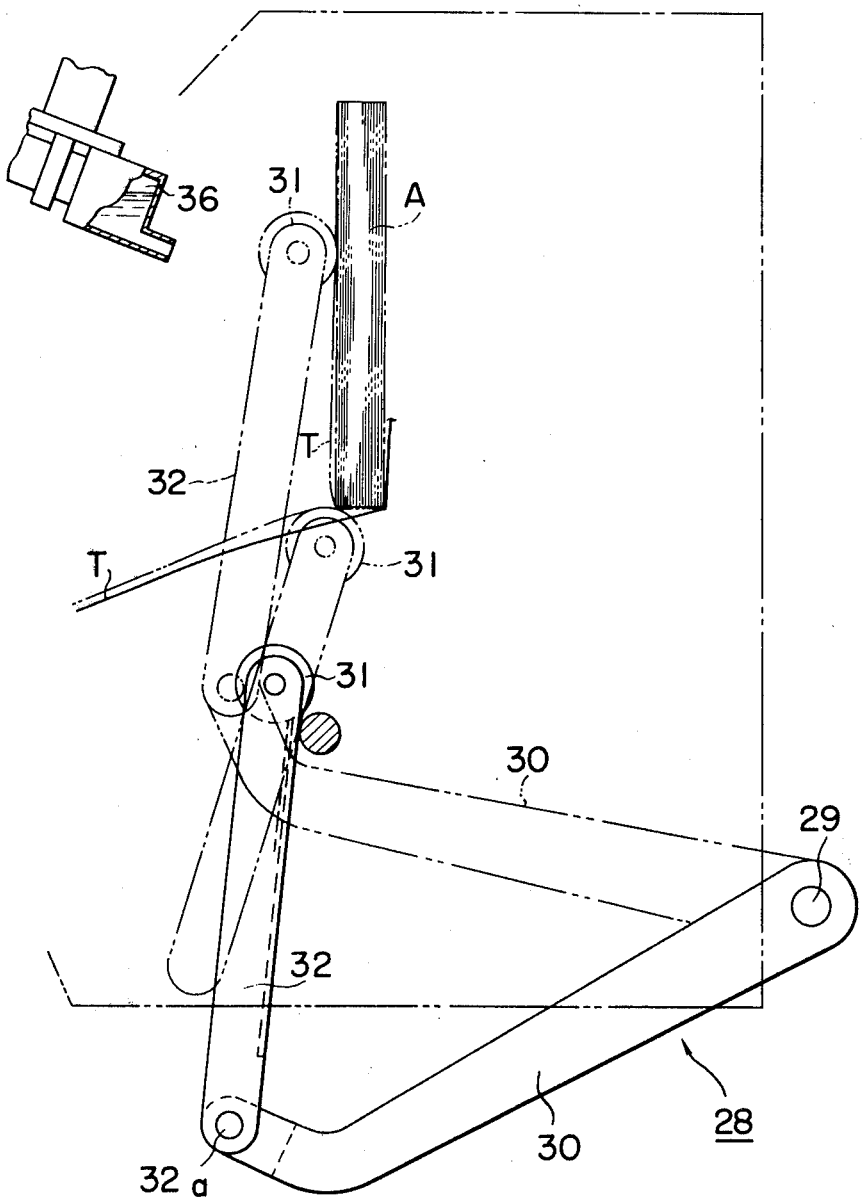
FIG. 5 is a front elevation of a tape end adhering means.
Figure 6:
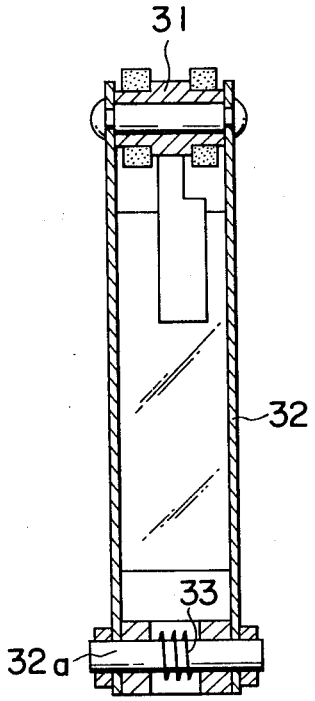
FIG. 6 is a side elevation, in vertical section, of an arm of the tape end adhering means.

An adhesive feeder 36 is then brought near the tape wrapped around the pack A to deposit an adhesive thereon. Thereafter, the tape cutter 35 is actuated to cut the tape. As shown in FIG. 5, the rotatable shaft 29 is actuated to swing upwardly the larger arm 30 and the smaller arm 32, whereby the pressing roller 31 carried by one end of the arm 32 raises and presses that part of the tape T which has been extending between the bottom of the pack A and the cutter 35 onto the part of the tape on which the adhesive has been deposited. Thus, the adhesive sticking operation is completed.

In this manner, there is formed a bound pack on the pack guiding trough, the tape T encircling the pack a number of times and binding it, and the cut end of tape T being stuck by adhesive to the leading tape portion which has been wound around the pack A. By manually drawing back the pack A on the guiding trough 2, the extension 5 can be drawn smoothly from between the tape T and one side of the pack A. Thus, the desired pack bound by the tape is obtained.

While the preferred embodiment of the invention has been described above with respect to a pack of paper money as one example of an article to be bound, the invention is not limited to a pack, wad or stack of sheet material. Furthermore, it will be apparent also that a specific tape, such as a vinyl tape, can be used as required for an article to be bound. The following several operations of the apparatus are all successively and automatically controlled by programming and sequence circuits in the control means.

Starting the tape feeding and drawing back roller means 8 when the inserted pack A abuts against the pack stop wall 13.

Stopping the roller means 8 when the tape T is fed by a predetermined length such that the end T1 of tape T depends in front of the clamper 3.

Slidingly retracting the cylindrical tape guide 7 after actuation of the clampers 3 and 4.

Stopping the roller means 8 after the tape has been drawn back and tightened around the pack A with a desired tension.

Cutting the tape.

Actuating the adhesive feeder.

Since all of these operations can be accomplished by control means known in the prior art, description of such means will be omitted.

Of course, means other than the tape cutter and adhesive feeder described herein can be used. Thus, means wherein a tape which has adhesive deposited over its entire length and dried is pressed by a heated pressing roller 31 to fuse and stick the tape can be used.

The apparatus according to the present invention as described above is constructed and arranged to bind rapidly, easily and reliably an article to be bound with the use of a tape by using simple components such as a displaceable voluted tape guide passage 6 and a pair of clampers 3 and 4, one 3 being longer than the other 4.

I claim:

1. Apparatus for binding articles with tape comprising:

an article receiving structure for guiding an article into and positioning the same in binding position;

tape roller mean for feeding a specific length of a free end portion of a tape from a tape supply and subsequently drawing back the tape;

a tape guide for guiding said free end portion of the tape into a voluted and looped state of a number of turns around a part of the article thus positioned and movable in a manner to separate from and leave the tape in said state;

clamping means comprising an actuating mechanism and a pair of clamping members for clamping and holding the article in the binding position from opposite sides thereof, one clamping member having an extension for holding the leading extremity of the tape free end portion against the article, the tape in said state thereupon being drawn back by the tape roller means and thereby being bound tight around the article;

cutting means for cutting off the tape free end portion thus bound, thereby forming a trailing extremity thereof;

securing means for securing the tape trailing extremity to the tape portion thus bound; and control and actuating means operating upon reception of the article by the article receiving structure to operate in appropriate sequence the tape roller means, the tape guide, the clamping means, the cutting means, and the securing means.

2. Apparatus for binding articles with tape as claimed in claim 1, in which the securing means comprises adhesive feeding means for feeding an appropriate quantity of an adhesive to an outer part of the tape binding the article, and means for pressing the trailing extremity against the part of the tape thereby to cause adhesion therebetween.

3. Apparatus as claimed in claim 2, in which said adhesive feeding means is movable toward and away from said outer part of the tape binding the article.

4. Apparatus as claimed in claim 2, in which said means for pressing the trailing extremity comprises a pressing roller and a mechanism supporting the pressing roller for causing the same to roll on and along said outer part of the tape binding the article while moving the trailing extremity of the tape onto said part.

5. Apparatus as claimed in claim 1, in which said article receiving structure comprises an article supporting plate for slidingly receiving the article thereon and an article stop wall providing abutment means for the article being slid on the article supporting plate.

6. Apparatus as claimed in claim 1, in which said tape roller means comprises a pair of rollers forming therebetween a nip through which the tape is fed, one of said roller being idle and the other being connected to a reversible motor.

7. Apparatus as claimed in claim 1, in which said tape guide is formed with a voluted tape guide passage means.

8. Apparatus as claimed in claim 7, further including a hollow case supporting thereon said tape guide in a manner slidable therealong between a first position in which said free end portion of the tape can be inserted in said tape guide passage means and a second position in which said free end portion of the tape is released from said tape guide passage.

9. Apparatus as claimed in claim 1, in which said actuating mechanism of the clamping means comprises a pair of bell crank levers privotally mounted for movement toward and away from each other and carrying said clamping members, respectively.

10. Apparatus as claimed in claim 1, in which said extension of the one clamping member is a sheet plate having a thickness less than that of the remaining part of the one clamping member.

11. Apparatus as claimed in claim 1, in which said cutting means is disposed between said tape roller means and said tape guide.

12. Apparatus as claimed in claim 8, in which said hollow case has an interior space receiving therein said article receiving structure and said clamping means.

* * * * *